United States Patent [19]

Hendrix et al.

[11] Patent Number: 4,756,714

[45] Date of Patent: Jul. 12, 1988

[54] METHOD OF DURABLY SIZING TEXTILE YARNS, DURABLE SIZING COMPOSITION, AND DURABLY SIZED YARNS AND FABRICS PRODUCED THEREFROM

[75] Inventors: James E. Hendrix, Spartanburg; Nigel E. Neely, Rock Hill; Martin K. Lindemann, Greenville, all of S.C.

[73] Assignee: Springs Industries, Inc., Fort Mill, S.C.

[21] Appl. No.: 750,415

[22] Filed: Jun. 28, 1985

[51] Int. Cl.[4] ..... D01F 11/00; D02G 3/36

[52] U.S. Cl. ..... 8/115.6; 28/178; 139/426 R; 427/389.9; 428/290; 428/361; 428/392; 428/393; 428/395; 524/809; 524/820; 524/829

[58] Field of Search ..... 524/820, 809, 829; 427/389.9; 8/115.6; 28/178; 428/290, 361, 392, 393, 395

[56] References Cited

U.S. PATENT DOCUMENTS

| | | | |
|---|---|---|---|
| 2,803,607 | 8/1957 | Shroh | 260/8 |
| 2,897,101 | 7/1959 | Graulich | 427/389.9 |
| 3,094,371 | 6/1963 | Van Loo | 8/115.6 |
| 3,178,385 | 4/1965 | Dinges | 427/389.9 |
| 3,199,167 | 8/1965 | Charlton | 427/389.9 |
| 3,262,899 | 7/1966 | Armour | 427/389.9 |
| 3,377,199 | 4/1968 | Altau | 427/389.9 |
| 3,402,061 | 9/1968 | Faria | 427/389.9 |
| 3,420,702 | 1/1969 | Spangler | 427/389.9 |
| 3,459,698 | 8/1969 | Mantell | 427/389.9 |
| 3,474,061 | 10/1969 | Von Bonin | 524/829 |
| 3,594,337 | 7/1971 | Shea | 428/361 |
| 3,666,400 | 5/1972 | Lofton | 8/115.6 |
| 3,676,207 | 7/1972 | Lofton | 8/115.6 |
| 3,910,759 | 10/1975 | Sthare | 427/389.9 |
| 3,944,690 | 3/1976 | Distler | 427/389.9 |
| 3,974,321 | 10/1976 | Baron | 427/389.9 |
| 4,358,501 | 11/1982 | Temple | 427/389.9 |
| 4,410,588 | 10/1983 | Ling | 427/389.9 |
| 4,524,093 | 6/1985 | Devry | 8/115.6 |

FOREIGN PATENT DOCUMENTS 57985 8/1982 European Pat. Off. .

*Primary Examiner*—C. Warren Ivy

*Attorney, Agent, or Firm*—Bell, Seltzer, Park & Gibson

[57] ABSTRACT

Textile yarns are treated with a sizing composition which, when dried and cured, remains durably bound to the yarn throughout wet finishing operations and subsequent use. The sizing composition comprises an aqueous self-crosslinking emulsion copolymer derived from at least one ethylenically unsaturated monomer and a latent-crosslinking monomer. The sizing composition may also include a water soluble or dispersible film forming polymer and a reactive resin. The durable size coating beneficially contributes to both the physical and the aesthetic properties of the yarn and fabrics formed therefrom.

23 Claims, 1 Drawing Sheet

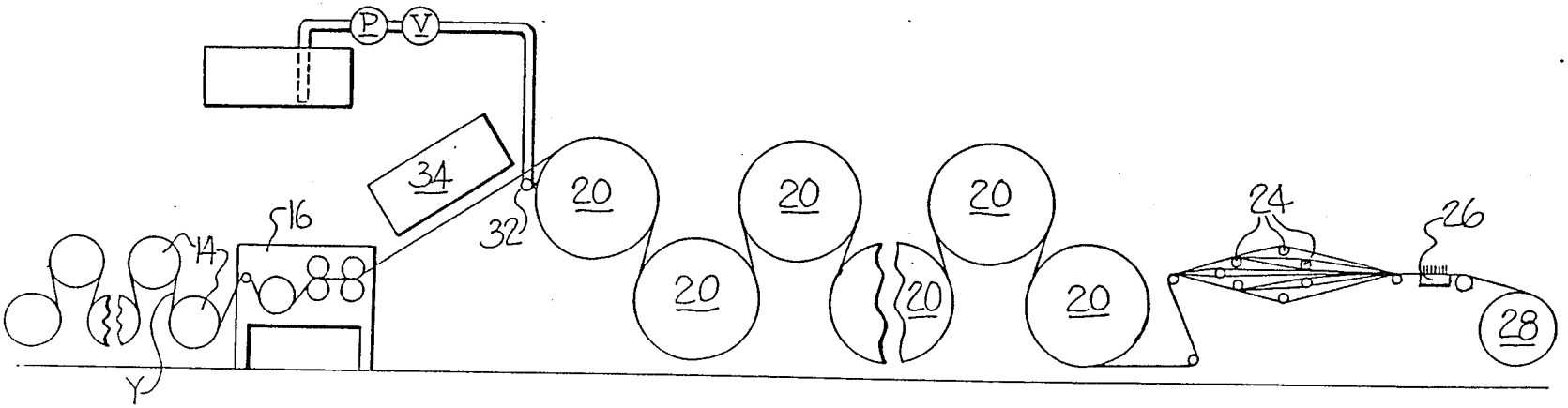
28
26
24
20
20
20
20
20
20
32
34
V
P
16
14
Y

METHOD OF DURABLY SIZING TEXTILE YARNS, DURABLE SIZING COMPOSITION, AND DURABLY SIZED YARNS AND FABRICS PRODUCED THEREFROM

FIELD OF THE INVENTION

This invention relates to a method and composition for sizing textile yarns, wherein the sizing composition forms a durable coating on the yarn that remains during subsequent finishing operations and even during normal use of the fabric. The invention also relates to durably sized yarns thus produced and to fabrics formed therefrom.

BACKGROUND OF THE INVENTION

In the processing of textile yarns to form fabrics, it has been conventional to apply a protective sizing composition to the yarns prior to fabric formation, such as weaving, in order to keep the yarns from being abraded and damaged during the fabric formation operations. Starches, polyvinyl alcohol, polyacrylates, polyacrylamides, and polyesters are some of the compositions which have been typically used as sizing compositions.

After the fabric is formed, it is conventionally subjected to a desizing operation to remove the sizing composition prior to bleaching, dyeing, and finishing. The desizing step has been necessary because the presence of the sizing composition on the yarns interferes with the bleaching, dyeing and finishing operations, and if not removed would adversely affect final aesthetic properties of the fabric. The desizing operation is an undesired extra step in textile processing which introduces additional processing time and expense. Additionally, because of the expense of the sizing compositions, as well as governmental regulations on waste water quality, desizing operations may require expensive reclamation or treatment facilities to reclaim the sizing composition and remove it from the waste water, or to treat the waste water to make it pure enough to discharge.

It has been previously recognized that it would be desirable to have a sizing composition which could be permanently applied to yarns, and which would therefore avoid the need for desizing and the attendant time and expense involved in size reclamation. Although there has been considerable interest in the development of a permanent sizing composition, the prior attempts to provide such a composition have been generally unsuccessful. In order to be acceptable for use in commercial production, a permanent sizing composition must meet a number of exacting criteria. The composition must be applied using conventional textile slashing equipment and must serve the intended functions of a yarn size during formation of the fabric. Furthermore, it must not be removed by or chemically degraded by caustic scouring operations, bleaching, mercerizing, dyeing, and fabric finishing processes. Also, the sizing composition which is present on the yarns must be fully compatible with conventional dyes and finishing agents so that the fabric may be dyed and finished using conventional dyes and production processes. In addition, it must meet all of the foregoing criteria without conferring undesirable fabric aesthetics or inferior fabric physical properties.

Prior attempts known to applicants at producing a permanent sizing process and composition have failed to satisfy the foregoing exacting criteria and have therefore not been acceptable for use in commercial operations, except perhaps in certain very specialized applications. Typically, the prior approaches have involved attempts to use conventional non-durable sizing agents, and to cause them to become permanently bound to the yarn through the use of a crosslinking agent. This approach is described, for example, in U.S. Pat. Nos. 3,676,207 and 3,666,400, and in European patent application No. 57,985.

SUMMARY OF THE INVENTION

In accordance with the present invention a method is provided for durably sizing textile yarns which entails applying to the yarns a coating of an aqueous sizing composition comprising an aqueous self-crosslinking emulsion copolymer. After application, the sizing composition is dried and cured on the yarns to crosslink and insolubilize the emulsion copolymer and produce a yarn having a size coating which remains durably bound to the yarn throughout wet finishing operations and during subsequent use and which beneficially contributes to the physical and aesthetic properties of the yarn. The aqueous self-crosslinking emulsion copolymer is derived from a reactive latent-crosslinking monomer and at least one ethylenically unsaturated monomer. The sizing composition may also suitably contain a hydroxyl containing water soluble polymer, such as starch, and a reactive resin, such as a melamine resin.

Also forming a part of the present invention is the aqueous durable sizing composition as well as durably sized yarns formed from the sizing composition and method of this invention, and fabrics formed from such yarns. The yarns and fabrics have enhanced aesthetic and physical properties as compared to conventional non-durably sized yarns.

BRIEF DESCRIPTION OF THE DRAWING

Some of the features and advantages of the invention having been described, others will become apparent from the detailed description and examples which follow, and from the accompanying drawing, which is a schematic illustration of a conventional textile slasher apparatus which may be used for applying the durable textile sizing composition in accordance with the present invention.

DETAILED DESCRIPTION

The present invention will be understood more fully from the description which follows, and from the accompanying examples, in which particular embodiments of the invention are shown. It is to be understood at the outset, however, that persons of skill in the appropriate arts may modify the invention here described while still achieving the favorable results of this invention. Accordingly, the description and examples which follow are to be understood as being a broad teaching disclosure directed to persons of skill in the appropriate arts, and are not to be understood as limiting upon the present invention.

Durable Sizing Composition

The sizing composition of the present invention comprises an aqueous self-crosslinking copolymer emulsion which, when applied to a yarn and dried and cured, forms a durable crosslinked coating which will withstand subsequent textile processing operations such as weaving, heat setting, scouring, bleaching, mercerizing, dyeing, printing, and/or drying, as well as repeated home launderings and/or dry cleanings. By "durable" it is meant that the yarn will retain at least 50 percent by weight of the size coating after standard wet finishing operations (desizing, scouring, bleaching, mercerizing, dyeing, printing, and drying). The self-crosslinking nature of the aqueous emulsion polymer is critical to obtaining this kind of durability.

By "self-crosslinking38 it is meant that the copolymer contains reactive crosslinking sites, and when the coated yarn is subjected to appropriate conditions, such as elevated temperature conditions, a self-crosslinking mechanism takes place within the copolymer in which these reactive crosslinking sites react with one another to form a branched or crosslinked network or matrix which renders the copolymer coating durable and insoluble so as to withstand subsequent wet finishing operations as well as laundering and drycleaning in normal use of the fabric. Where the yarns contain fibers having reactive sites, such as cellulosic fibers for example, there may also be crosslinking through the reactive sites of the copolymer directly to the fiber. The crosslinking reaction may be activated by heating, by radiation or electron beam curing, and may employ catalysts or free radical initiators as is known in the art.

The aqueous self-crosslinking copolymer is produced by emulsion polymerization of one or more polymerizable primary monomers in the presence of a smaller proportion of at least one reactive functional latent-crosslinking comonomer. The major portion of the aqueous self-crosslinking emulsion polymer is derived from one or more ethylenically unsaturated monomers which are copolymerizable with the latent-crosslinking comonomer. Examples of suitable ethylenically unsaturated monomers include alpha olefins such as ethylene, propylene, butylene, isobutylene; diene monomers such as butadiene, chloroprene, isoprene; and aromatic and aliphatic vinyl monomers including vinyl halides such as vinyl chloride and vinylidene chloride; vinyl esters of alkanoic acids having from one to about eighteen carbon atoms, such as vinyl formate, vinyl acetate, vinyl propionate, vinyl butyrate, vinyl isobutyrate, vinyl valerate, vinyl 2-ethylhexanoate, vinyl isooctanoate, vinyl monoate, vinyl decanoate, vinyl pivalate, vinyl Versatate TM; vinyl esters of saturated carboxylic acids; vinyl aromatic compounds such as styrene, alpha methylstyrene, vinyl toluene, 2-bromostyrene, p-chlorostyrene; and other vinyl monomers such as acrylonitrile, methacrylonitrile, N-vinylpyrrolidone, maleate, fumarate, and itaconate esters of $C_1$ to $C_8$ alcohols. Also suitable are acrylic monomers, and in particular $C_2$–$C_{18}$ alkyl acrylates and $C_2$–$C_{18}$ alkyl methacrylates. Examples of the $C_2$–$C_{18}$ alkyl groups of the esters of acrylic and methacrylic acids which are useful in forming the copolymers of the invention include methyl, ethyl, n-butyl, i-butyl, sec-butyl t-butyl, the various isomeric pentyl, hexyl, heptyl, and octyl (especially 2-ethylhexyl), isoformyl, lauryl, cetyl, stearyl, and like groups. Preferred ethylenically unsaturated monomers for the present invention are selected from the group consisting of aliphatic and aromatic vinyl monomers. Especially preferred as the primary monomers are unsaturated monomers selected from the group consisting of alkyl acrylates, alkyl methacrylates, acrylonitrile, acrylamide, styrene and vinyl acetate. It is particularly suitable to use mixtures of two or more ethylenically unsaturated monomers such as butyl acrylate and methyl methacrylate, butyl acrylate and styrene, butyl acrylate and acrylonitrile, butyl acrylate and vinyl acetate, ethyl acetate and styrene and ethyl acetate and methyl methacrylate.

In order to impart the desired hand properties in fabrics formed from the durably sized yarns of this invention, it is especially desirable that the emulsion copolymer be formulated to have a relatively low glass transition temperature ($T_g$). "$T_g$" or glass transition temperature is described by Flory, "Principles of Polymer Chemistry", pp. 56 and 57 (1953), Cornell University Press. See also "Polymer Handbook", 2nd Ed., Brandrup and Immergut, Sect. 111, pp. 139–142, Interscience (1975). The preferred self-crosslinking polymers for use in the present invention have a $T_g$ of from −60° to 100° C., and most preferred are those copolymers which have a $T_g$ of from −30° to 0° C.

The glass transition temperature of the self-crosslinking copolymer of the invention may be controlled as desired by appropriate selection and/or blending of monomers whose homopolymers have differing hardness or softness. Examples of monomers which yield relatively soft (low $T_g$) homopolymers include butyl acrylate, ethyl acrylate, butyl methacrylte, 2-ethylhexyl methacrylate, vinyl propionate, vinylester versatate, and ethylene. Examples of monomers which yield relatively hard (high $T_g$) homopolymers include methyl methacrylate, styrene, vinyl acetate, acrylonitrile, and vinyl chloride. A convenient method of calculating the $T_g$, based upon the $T_g$ of homopolymers of individual monomers, is described by Fox, Bull. Am. Physics. Soc., 1,3, page 123 (1956). Tables of the $T_g$ of the homopolymers are widely available and include the one in "Polymer Handbook" Section III, part 2, by W. A. Lee and R. A. Rutherford. Monomers may be selected to obtain the appropriate $T_g$ through the use of the "Rohm and Haas Acrylic Glass Temperature Analyzer", publication CM-24 4/76 of Rohm and Haas Co., Philadelphia, Pa.

The reactive functional latent-crosslinking monomers which are preferred for use in the present invention are characterized by being readily copolymerizable with the other monomers, and also by being capable of curing, generally in the presence of a catalyst, by means of heat or radiation. Suitable latent-crosslinking monomers may be broadly characterized as N-alkylolamides of alpha, beta ethylenically unsaturated carboxylic acids having 3–10 carbons, such as N-methylol acrylamide, N-ethanol acrylamide, N-propanol acrylamide, N-methylol methacrylamide, N-ethanol methacrylamide. Also suitable are N-methylol maleimide, N-methylol maleamide, N-methylol maleamic acid, N-methylol maleamic acid esters, the N-alkylol amides of the vinyl aromatic acids such as N-methylol-p-vinylbenzamide and the like, N-butoxymethyl acrylamide, N-methylol allyl carbamate, glycidyl acrylate, glycidyl methacrylate, hydroxyethyl acrylate, hydroxypropyl acrylate and the corresponding methacrylates. Particularly preferred as a latent-crosslinking monomer for use in the present invention is N-methylolacrylamide or mixtures of N-methylolacrylamide and acrylamide.

The latent-crosslinking monomers are present in an amount sufficient to render the copolymer insoluble upon curing and crosslinking of the sizing composition on the yarns, but in an amount less that which would cause any significant premature crosslinking during formulation and application. The latent-crosslinkable monomers preferably are present in an amount ranging from about 5 to 100 parts per 1000 parts of the primary monomers, by weight, and most desirably about 10 to 60 parts per 1000 parts of the primary monomers. This typically represents about 0.5 to 10 percent by weight of the copolymer.

Copolymers in accordance with the present invention also may desirably include small amounts of an acid monomer, preferably an ethylenically unsaturated carboxylic acid. Generally, any ethylenically unsaturated mono or dicarboxylic acid may be used to provide the carboxyl functionality. Examples of suitable acids include the monocarboxylic ethylenically unsaturated acids such as acrylic, vinyl acetic, crotonic, methacrylic, sorbic tiglic, etc.; the dicarboxylic ethylenically unsaturated acids such as maleic, fumaric, itaconic, citraconic, hydromuconic, allylmolonic, etc., as well as the halfesters of these dicarboxylic acids such as mono(2-ethylhexyl) maleate, monoethylmaleate, monobutylmaleate, monomethylmaleate. Especially suitable are acid monomers selected from the group consisting of acrylic acid, methacrylic acid, crotonic acid, maleic acid, and itaconic acid. These acid monomers are used in conventional nondurable acrylic sizing compositions in relatively high amounts, typically 20 to 50 percent by weight, to impart alkali removability to the sizing composition. In accordance with the present invention, the presence of these monomers in small amounts, typically ranging from about 0.1 to 10 percent by weight of the copolymer (1 to 100 parts per 1000 parts of the primary monomer), and most desirably 1 to 4 percent, gives desirable processing characteristics during the slashing operation and acts as a functional site for crosslinking with other latent-crosslinking agents. By adjusting the pH of the size bath to around 6.5 to 7 with a suitable alkaline agent, such as ammonium hydroxide, the acid monomer in the copolymer chain will decrease build-up of the sizing composition on the pad roll, without adversely affecting the durability, i.e. insolubility, of the copolymer after curing.

The copolymer also preferably includes small amounts of an active crosslinking monomer to give internal crosslinking and branching to increase the molecular weight of the copolymer. By the term "active crosslinking monomer" is meant a polyfunctional monomer which crosslinks a polymer composition during the initial formation thereof. Subsequent drying and curing techniques are not required. Monomers of this type comprise monomers which contain two or more ethylenically unsaturated groups in one molecule capable of undergoing additional polymerization by free radical means.

Examples of suitable active crosslinking monomers include alkylene glycol diacrylates and methacrylates such as ethylene glycol diacrylate, 1,3-butylene glycol diacrylate, propylene glycol diacrylate, triethylene glycol dimethacrylate etc., 1,3-glycerol dimethacrylate, 1,1,1-trimethylol propane dimethacrylate, 1,1,1-trimethylol ethane diacrylate, pentaerythritol trimethacrylate, 1,2,6-hexane triacrylate, sorbitol pentamethacrylate, methylene bisacrylamide, methylene bismethacrylamide, divinyl benzene, vinyl methacrylate, vinyl crotonate, vinyl acrylate, vinyl acetylene, trivinyl benzene, triallyl cyanurate, triallyl isocyanurate, divinyl acetylene, divinyl ethane, divinyl sulfide, divinyl ether, divinyl sulfone hexatriene, diallyl cyanamide, ethylene glycol divinyl ether, diallyl phthalate, divinyl dimethyl silane, glycerol trivinyl ether, divinyladipate, allyl methacrylate, allyl acrylate, diallyl maleate, diallyl fumarate, diallyl itaconate, diallyl succinate, diallyl malonate, diallyl carbonate, triallyl citrate, triallyl aconitate.

The amount of the active crosslinking monomer may typically range from about 0.01 to about 2.0 percent (1 to 20 parts per 1000 parts of primary monomer), preferably 0.05 to 0.6 percent by weight of the copolymer and the molecular weight of the emulsion copolymer, prior to final drying and curing, is quite high and may typically range from 100,000 to several million.

As earlier noted, the aqueous self-crosslinking copolymer is produced by emulsion copolymerization using conventional emulsion polymerization procedures and surfactants, polymerization catalysts and other additives as are conventional for such procedures. These procedures and the various surfactants, catalysts, and other additives are known in the art. The practice of emulsion polymerization is discussed in detail in D. C. Blackley, "Emulsion Polymerization", (Wiley, 1975). The size of the resulting polymer particles in the emulsion may typically range from 0.05 to 1.0 microns, preferably about 0.1 to about 0.5 microns. The polymer emulsion typically has a solids content of about 40 to 60 percent as produced.

The thus produced self-crosslinking copolymer emulsion may be used in this form as the sizing composition, but it is preferred that certain reactants and size bath additives first be blended with the self-crosslinking copolymer emulsion. For example, to prevent premature crosslinking and facilitate application in the pad bath, ammonium hydroxide or other suitable alkaline material is preferably added to the emulsion to adjust the pH of the composition from its initial acid condition to a pH of about 5 to 10, preferably about 6.5 to 7.

Additionally, it is preferable to also include in the aqueous sizing composition a small amount, e.g. from about 1 to 3 percent by weight, of a water soluble or water dispersible film forming polymer which will form a polymer blend with the self-crosslinking copolymer to reduce the tackiness of the cured self-crosslinking polymer film, which because of its low $T_g$ could cause blocking of the warp yarns on the loom beam. Examples of suitable water soluble or water dispersible film forming detackifying polymers include hydroxyl containing polymers such as starch and polyvinyl alcohol, carboxy acrylic polymers, and sulfonated polyesters.

To enhance the durability of the water soluble or dispersible film forming detackifying polymer on the yarn, a small amount of a reactive resin is preferably added to the size bath composition. However, even in the absence of starch or other water soluble film forming detackifying polymers, the addition of small amounts of a reactive resin can serve to advantageously reduce the tackiness of the size coating. Examples of suitable reactive resins include aminoplast resins, glyoxal resins, aziridines, aldehydes, dialdehydes, epoxy resins, diepoxides, etc. Examples of alkylated aminoplasts which may be used include those obtained by the alkylation, with an alkanol having from 1 to 6 carbon atoms or cyclohexanol, of a condensate of an aldehyde with urea, N, N'-ethyleneurea, thiourea, N,N'-dimethylurea, biuret, dicyandiamide, and aminotriazines. Water-soluble condensates such as the methylated dimethylolurea condensates can be employed. Preferably, the alkylation products of alcohols having from 3 to 6 carbon atoms are employed and the butylated products are particularly valuable. Among the aminotriazines are melamine, acetoguanamine, benzoguanamine, formoguanamine, N-(t-butyl)-melamine, N-(t-octyl)-melamine in which the octyl group has the formula $—C(CH_3)2—CH_2—C(CH_3)3$, ammeline, 2-chloro-4, 6-diammino-1, 3,5-triazine, N-N-di($C_1$–$C_4$) alkyl melamines such as N, N-dimethylmelamine. While any aldehyde may be employed such as acetaldehyde, crotonaldehyde, and acrolein, the condensates obtained using formaldehyde and revertible polymers thereof such as paraformaldehyde are preferably employed. The reactive resin, when present, is preferably used at a concentration of about 0.1 to 3 by weight, preferably 0.5 to 1.5 percent, (solids basis) in the sizing composition. When a reactive resin is used in the size bath composition, it is preferably accompanied by a suitable catalyst for effecting reaction and curing of the resin.

Suitable catalysts for curing the self-crosslinking emulsion copolymer as well as the reactive resin, if present, include Lewis acids such as $MgCl_2$, $AlCl_3$, $BF_3$, $MgNO_3$, $MgSO_4$; ammonium salts of strong acids; Bronsted acids such as ammonium sulfate, ammonium phosphate; ammonium salts of organic acids, methane sulfonic acid, p-toluene sulfonic acid, etc. For certain reactive groups, alkaline catalysts will be preferred, including amines such as benzyl amine or diethylenetriamine, sodium hydroxide, potassium hydroxide, sodium carbonate, sodium bicarbonate. The catalyst may be suitably used at a concentration ranging from 0.01 to 10 percent, preferably 0.1 to 3 percent.

The sizing composition may also suitably include conventional slasher bath additives such as lubricants, defoamers, antistats, fungicides, antifoams and the like as necessary depending upon mill conditions. Examples of suitable lubricants for the sizing composition include hydrogenated tallow glycerides, bleached fancy tallow, polyethylene glycols, ethoxylated castor oil, parafin oils and waxes, silicone lubricants, and ethoxylated hydroxy esters.

A representative sizing composition in accordance with the present invention is as follows:

| Ingredient | Percent solids in size bath composition (broad) | (preferred) |
|---|---|---|
| Self-crosslinking emulsion copolymer | 4–60 | 4–12 |
| Film forming detackifying polymer | 0–5 | 1–3 |
| Reactive resin | 0–3 | .5–1.5 |
| Catalyst | 0.01–10 | .1–3 |
| Additives: | | |
| lubricant | * | * |
| antifoam | * | * |
| alkaline compound | ** | ** |

*as required by various mill conditions
**as needed to adjust pH to 6.5–7.0

Application of Sizing Composition

The aqueous sizing composition of the present invention may be applied to the yarn using conventional equipment, such as the conventional textile slasher which is schematically shown in the drawing. As illustrated, a large number of textile yarns Y arranged in parallel side-by-side relation is supplied from section beams 14 and directed through a suitable applicator means, such as a pad 16, for applying the sizing composition to the yarns. After leaving the pad 16, the yarns pass across a series of heated metal drying cans 20 which serve to dry the sizing composition and to cause it to cure and crosslink to become durably bound to the yarns. Upon leaving the drying zone, the yarns and the dried and cured sizing composition form a continuous film. The yarns are passed across a series of split rods 24 which serve to split and break the film into individual yarns, thence through a comb 26, and the individual sized yarns are finally wound upon a loom beam 28 at a take-up station.

As the durable sizing composition of the present invention begins to dry and cure on the first drying can, it passes through a tacky, relatively sticky adhesive-like stage. In order to achieve higher operating speeds on the slasher, it is desirable in accordance with the present invention to apply a release agent to the first drying can to facilitate release of the yarns from the drying can. As schematically illustrated in the drawing, a series of nozzles 32 is provided for spraying a light application of a liquid release agent onto the first drying can 20. Suitable liquid release agents for use in the present invention include fatty acids such as lecithin, hydrocarbon oils and waxes such as polyethylene glycol, fluorinated surfactants, and silicone oils.

Also in order to increase the operating speed of the slasher, it is advantageous in accordance with the present invention to use application techniques and methods which minimize the wet pickup of the sizing composition on the yarns. One particularly suitable application method for minimizing wet pickup involves applying the sizing composition in the form of a foam. Other suitable methods involve the use of an engraved roll pad, a kiss roll applicator, a high pressure, high extraction pad, or the use of a pad applicator in combination with a vacuum extraction slot. Alternatively, the level of moisture on the yarns may be reduced by predrying prior to the yarns reaching the dryer can. This may be accomplished by suitable noncontact drying means 34 such as an infrared predryer located between the size applicator and the first drying can.

Durably Sized Yarns and Fabrics

Yarns which have been treated with the durable sizing process and composition of this invention have significantly improved physical and aesthetic properties as compared to unsized yarns or yarns sized by conventional nondurable sizing compositions. Since the sizing composition forms a permanent part of the yarn, durably sized yarns have greatly enhanced covering power. Stated otherwise, the durable size composition forms a permanent part of the yarn and thus makes the overall yarn larger. This means that a finer gauge durably sized yarn can be used in a fabric in place of a larger or heavier conventionally sized yarn, with the result that a given weight of yarn can produce more fabric.

The application of the durable sizing composition to the yarns has also been found to compensate for and reduce nonuniformities in the yarn as spun. This produces a fabric which is much more uniform in appearance, particularly in the dyed state.

In addition, the durable sizing composition of the invention has particular advantages on yarns produced in accordance with the recent developments in high speed, high production open end spinning and jet spinning techniques. While the increases in production speed increase efficiency and reduce cost, the dyed appearance of fabrics produced with such in fabric yarns is generally not as desirable as yarn formed from ring spun yarns. This is due to the particular structure of the yarn. A ring spun yarn has its fibers arranged substantially uniformly in a helical arrangement and the fibers are held in this arrangement by the twist of the yarn. A jet spun yarn, however, is constructed differently. The majority of the fibers extend generally parallel to the yarn axis, and intermittently certain fibers extend out of the fiber bundle and wrap or twist about the other fibers to bind the fibers together. When the yarns are woven into a fabric, the wrapper fibers tend to extend from the yarn into the interstices between yarns. The dyed fabric exhibits a distinctly different appearance from a fabric formed of ring spun yarns, which is characterized by a discernible "spider web" effect due to the wrapper fibers. It has been found that the permanent sizing composition makes the yarns more uniform by bonding these objectionable stray wrapper fibers, and that permanently sized jet spun yarns of this construction treated produce a woven fabric of a much higher quality appearance and aesthetics than heretofore.

Still another advantage of fabrics formed from durably sized yarns in accordance with the present invention is that the fabrics exhibit much better abrasion resistance. Tests have shown that fabrics formed from the durably sized yarn of the invention have as much as half the abrasion weight loss as compared to control fabrics which have been sized with conventional nondurable sizing compositions.

The illustrative non-limiting examples which follow describe the preparation and use as sizing compositions of various self-crosslinking emulsion polymers in accordance with the present invention.

EXAMPLE 1

A copolymer was prepared using 75 parts butyl acrylate, 25 parts methyl methacrylate, 1.5 parts itaconic acid, 3.5 parts of N-methylolacrylamide, 0.4 parts of acrylamide, and 0.1 part of triallyl cyanurate. A mixture of anionic and nonionic emulsifiers was used as stabilizer. The resulting latex had a solids content of 42%, a viscosity of 36 cps measured with a Brookfield viscometer at 50 RPM, a pH of 3.3 and a calculated glass transition temperature ($T_g$) of about −30° C.

A sizing composition was made up by blending 20 gal. of this latex with a solution of 63.5 lbs. of polyvinyl alcohol (1) in 80 gal. of water. To this was added 1.75 gal. of a 80% solids melamine formaldehyde resin, (2) 1.2 gal. of 40% active solution of paratoluene sulfonic acid (3), 1 gal of a ethoxylated castor oil (4), 1.5 gal. of a silicone lubricant (5) and enough water to make a total of 150 gal.

(1) Elvanol T-66, a grade of polyvinyl alcohol supplied by E. I. DuPont and Co. (2) Resin MW supplied by the American Cyananid Company (3) Catalyst 4040, supplied by the American Cyananid Company (4) Texwax 11 supplied by Palmetto Chemical Co. (5) Silicone 2162 supplied by the General Electric Company A yarn of polyester/cotton blend (65/35) was sized with this composition and dried on heated cans at a temperature of 270° F. After weaving this yarn, the fabric was heat set at 400° F. for 20 seconds and then processed normally by desizing, scouring and bleaching. The retention of size on the yarn was 78% (6).

(6) The retention was determined as follows: 20 pieces of sized yarn, and 20 pieces of unsized yarn were dried to constant weight at 105° C. for 1 hour. The percent add-on was then determined by weight difference. A piece of fabric woven from unsized and sized yarn was then processed in a normal manner and the weights compared.

EXAMPLE 2

The procedures and materials of Example 1 were used with the exception that the polyvinyl alcohol solution was replaced by a starch solution of 25 lbs. starch (Kofilm 50 supplied by the National Starch & Chemical Company) in 50 gal. of water. The retention of the fabric after normal processing was 67.1%.

The following examples describe retention experiments using a size composition to treat woven unsized fabric made from a polyester-cotton blend.

EXAMPLE 3

125 g. of a 44.4% solids latex of a copolymer of 70 parts butylacrylate, 30 parts acrylonitrile, 1.5 part itaconic acid, 3.5 parts N-methylolacrylamide, and 0.1 part triallylcyanurate having a calculated Tg of −23° C., was blended with 3 g. of a 40% solution of paratoluene sulfonic acid, and water was then added to make 250 g. of a sizing composition. A piece of unsized polyester cotton cloth was treated with this solution and then dried at 250° F. for 60 seconds, cured at 400° F. for 30 seconds. The fabric was weighed before and after the treatment. The treated fabric was then desized with water for 1 minute at 145° F., scoured for 1 minute at 180° F. with a 3% caustic solution, held in a laboratory J box for 1 hour at 200° F., washed for 1 minute in 145° F. water and then bleached with a solution of 1.5% sodium silicate
1% caustic
0.1% octylphenol ethylene oxide condensate having 10 moles of ethylene oxide per mole of octylphenol (Triton X 100 supplied by the Rohm and Haas Co.)
3% hydrogen peroxide (50% active) and
water to 100%, for 1 minute at 90° F. After this the fabric was again kept for 1 hour in a J-box at 200° F., washed for 1 minute at 145° F., and dried. The fabric weights were compared before and after this treatment and the retention calculated. The retention was 88.6%.

EXAMPLE 4

The procedures of Example 3 were used, except that the fabric was treated with the following size composition:

111.6 g of a 44.8% solids latex of a copolymer of 50 parts butylacrylate, 50 parts styrene, 1.5 parts itaconic acid, 3.5 parts N-methylolacrylamide, 0.4 parts acrylamide and 0.1 part triallyl-cyanurate having a calculated $T_g$ of 1° C.
89 g of a 7% starch solution in water (Kofilm 50 supplied by the National Starch and Chemical Corporation).
2 g of paratoluene sulfonic acid (Catalyst 4040, American Cyananmid Co.).

After drying, curing, and processing the fabric as in Example 3, the retention was determined to be 82 percent.

EXAMPLE 5

The procedures of Example 3 were used, except that the fabric was treated with the following size composition:

111.6 g of a 43.7% solids latex of a polymer of 100 parts butyl acrylate, 1.5 part itaconic acid, 3.5 parts N-methylolacrylamide, 0.4 parts acrylamide and 0.1 part triallylcyanurate having a calculated Tg of −56° C.
89 g of a 7% starch solution in water (Kofilm 50) supplied by the National Starch and Chemical Corporation).
3 g of a 80% melamine formaldehyde resin solution (Resin MW of American Cyanamid)
2 g of paratoluene sulfonic acid (Catalyst 4040, American Cyanamid).

After drying, curing and processing the fabric as in Example 3, the retention was determined to be 81.8%.

What is claimed is:

1. A method of producing textile yarns suitable for forming textile fabrics therefrom, said yarns being characterized by having a durable size coating which remains bound to the yarn throughout wet finishing operations and subsequent use and which beneficially contributes to the physical and aesthetic properties of the yarn, said method comprising providing a supply package containing a plurality of textile yarns, advancing the plurality of textile yarns from the supply package along a predetermined path of travel to and through a coating station and applying to the yarns an aqueous sizing composition comprising an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturated carboxylic acid having 3 to 10 carbon atoms, directing the coated yarns from the coating station to and through a drying zone and heating the yarns to dry the aqueous sizing composition and to crosslink and insolubilize the self-crosslinking copolymer, and directing the thus coated yarns from the drying zone to a take-up station and winding the coated yarns on a take-up roll.

2. A method according to claim 1 wherein said at least one ethylenically unsaturated monomer is selected from the group consisting of aliphatic and aromatic vinyl monomers.

3. A method of producing textile yarns suitable for forming textile fabrics therefrom, said yarns being characterized by having a durable size coating which remains bound to the yarn throughout wet finishing operations and subsequent use and which beneficially contributes to the physical and aesthetic properties of the yarn, said method comprising providing a supply package containing a plurality of textile yarns, advancing the plurality of textile yarns from the supply package along a predetermined path of travel to and through a coating station and applying to the yarns an aqueous sizing composition comprising an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturated carboxylic acid having 3 to 10 carbon atoms; a water soluble or dispersible film forming detackifying polymer selected from the group consisting of starch, polyvinyl alcohol, carboxy acrylic polymers and sulfonated polyesters; and a reactive resin selected from the group consisting of aminoplast resins, glyoxal resins, aziridines, aldehydes, dialdehydes, epoxy resins and diepoxides;

directing the coated yarns from the coating station to and through a drying zone and heating the yarns to dry the aqueous sizing composition and to crosslink and insolubilize the self-crosslinking copolymer, and directing the thus coated yarns from the drying zone to a take-up station and winding the coated yarns on a take-up roll.

4. A method according to claim 3 wherein said sizing composition comprises 4 to 12 percent of said self-crosslinking emulsion copolymer, 1 to 3 percent of said water soluble or dispersible film forming polymer, 0.1 to 3 percent of said reactive resin, and 0.01 to 10 percent catalyst, all percentages being total weight percent of solids in the sizing composition.

5. A method according to claim 3 wherein said at least one ethylenically unsaturated monomer is selected from the group consisting of alkyl acrylates, alkyl methacrylates, acrylonitrile, acrylamide, styrene and vinyl acetate.

6. A method according to claim 4 wherein said aqueous self-crosslinking emulsion polymer also includes an acid monomer selected from the group consisting of acrylic acid, methacrylic acid, crotonic acid, maleic anhydride, and itaconic acid, and wherein the aqueous self-crosslinking emulsion copolymer is maintained at a pH of 6.5 to 7 when applied to the yarns.

7. A method according to claim 4 wherein said water soluble or dispersible film forming polymer comprises starch and said reactive resin comprises a melamine resin.

8. A method of durably sizing textile yarns comprising applying to the yarns a coating of an aqueous sizing composition comprising an aqueous self-crosslinking emulsion copolymer having a $T_g$ of −30° C. to 0° C. and consisting essentially of (a) at least one primary monomer selected from the group consisting of aliphatic and aromatic vinyl monomers;

(b) 5 to 100 parts per 1000 parts of said primary monomer of an N-alkylolamide of an alpha, beta ethylenically unsaturated carboxylic acid having 3 to 10 carbon atoms;

(c) 1 to 100 parts per 1000 parts of said primary monomer of an ethylenically unsaturated carboxylic acid; and (d) 1 to 20 parts per 1000 parts of said primary monomer of a polyfunctional active crosslinking monomer; and drying and curing the aqueous sizing composition on the yarns to crosslink and insolubilize the emulsion copolymer and produce a yarn coating having a size coating which remains durably bound to the yarn throughout wet finishing operations and subsequent use and which beneficially contributes to the physical and aesthetic properties of the yarn.

9. a method according to claim 1 wherein the step of applying to the yarns a coating of an aqueous sizing composition comprises applying the sizing composition in the form of a foam.

10. A method according to claim 1 wherein said step of applying to the yarns a coating of an aqueous sizing composition includes the step of reducing the wet pickup of the aqueous sizing composition on the yarns after application to the yarns and prior to directing the yarns onto the drying zone.

11. A durably sized textile yarn produced by the process of any one of claims 3 and 8.

12. A textile fabric having reduced pilling and enhanced abrasion resistance and which comprises durably sized textile yarns produced by the process of any one of claims 3 and 8.

13. A textile yarn formed of spun staple fibers, and a coating of a durable sizing composition protectively surrounding the yarn, said sizing composition comprising a self-crosslinked emulsion polymer consisting essentially of at least one ethylenically unsaturated monomer selected from the group consisting of alkyl acrylates, alkyl methacrylates, acrylonitrile, acrylamide, styrene and vinyl acetate, and a reactive latent-crosslinking monomer comprising an N-alkylolamide of an alpha, beta ethylenically unsaturated carboxylic acid having 3 to 10 carbon atoms.

14. A yarn according to claim 13 wherein said yarn is a jet-spun yarn.

15. A yarn according to claim 13 wherein said yarn is a ring-spun yarn.

16. A textile yarn formed of spun staple fibers, and a coating of a durable sizing composition protectively surrounding the yarn, said sizing composition comprising an aqueous self-crosslinking emulsion copolymer derived from at least one ethylenically unsaturated monomer and a latent-crosslinking monomer comprising an N-alkylolamide of an alpha, beta ethylenically unsaturated carboxylic acid having 3 to 10 carbon atoms, a water soluble or dispersible film forming polymer selected from the group consisting of hydroxyl containing polymers, carboxy acrylic polymers, and sulfonated polyesters, and a reactive resin selected from the group consisting of aminoplast resins, glyoxal resins, aziridines, aldehydes, dialdehydes, epoxy resins and diepoxides, said sizing composition forming a cured, crosslinked coating around the yarn which remains durably bound to the yarn throughout wet finishing operations and subsequent use and which beneficially contributes to the physical and aesthetic properties of the yarn.

17. A textile yarn according to claim 16 wherein said sizing composition comprises 4 to 12 percent of said self-crosslinking emulsion copolymer, 1 to 3 percent of said water soluble or dispersible film forming polymer, 0.1 to 3 percent of said reactive resin and 0.01 to 10 percent catalyst.

18. A textile yarn having a coating of a durable sizing composition comprising an aqueous self-crosslinking emulsion copolymer having a calculated $T_g$ of −30° C. to 0° C. and consisting essentially of (a) at least one primary monomer selected from the group consisting of aliphatic and aromatic vinyl monomers;

(b) 5 to 100 parts per 1000 parts of said primary monomer of an N-alkylolamide of an alpha, beta ethylenically unsaturated carboxylic acid having 3 to 10 carbon atoms;

(c) 1 to 100 parts per 1000 parts of said primary monomer of an ethylenically unsaturated carboxylic acid; and (d) 1 to 20 parts per 1000 parts of said primary monomer of a polyfunctional active crosslinking monomer; said sizing composition forming a cured, crosslinked coating around the yarn which remains durably bound to the yarn throughout wet finishing operations and subsequent use and which beneficially contributes to the physical and aesthetic properties of the yarn.

19. A method according to claim 1 wherein said step of directing the coated yarns to and through a drying zone comprises directing the coated yarns over a heated drying can.

20. A method according to claim 19 including the additional step of applying to said heated drying can a release agent to prevent build up of the sizing composition on the drying can.

21. A method of producing a textile fabric formed of textile yarns having a size coating which is durably bound to the yarns, comprising applying to the yarns a coating of an aqueous sizing composition comprising an aqueous self-crosslinking copolymer produced by emulsion polymerization of one or more ethylenically unsaturated monomers in the presence of a latent-crosslinking comonomer comprising an N-alkylolamide of an alpha, beta ethylenically unsaturted carboxylic acid having 3 to 10 carbon atoms, drying and curing the sizing composition on the yarns to crosslink and insolubilize the aqueous self-crosslinking copolymer and to produce yarns having a size coating which remains durably bound to the yarns throughout wet finishing operations and subsequent use and which beneficially contributes to the physical and aesthetic properties of the yarns, forming the yarns into a fabric, and thereafter subjecting the fabric to wet finishing operations without prior removal of the size coating from the yarns.

22. A method of producing a textile fabric formed of textile yarns having a size coating which is durably bound to the yarns, comprising applying to the yarns a coating of an aqueous sizing composition comprising an aqueous self-crosslinking copolymer produced by emulsion polymerization of butyl acrylate and methyl methacrylate in the presence of a latent-crosslinking comonomer comprising an N-alkylolamide of an alpha, beta ethylenically unsaturated carboxylic acid having 3 to 10 carbon atoms, drying and curing the sizing composition on the yarns to crosslink and insolubilize the aqueous self-crosslinking copolymer and to produce yarns having a size coating which remains durably bound to the yarns throughout wet finishing operations and subsequent use and which beneficially contributes to the physical and aesthetic properties of the yarns, forming the yarns into a fabric, and thereafter subjecting the fabric to wet finishing operations without prior removal of the size coating from the yarns.

23. A textile yarn formed of spun staple fibers, and a coating of a durable sizing composition protectively surrounding the yarn, said sizing composition comprising a self-crosslinked emulsion copolymer consisting essentially of butyl acrylate and methyl methacrylate comonomers and a reactive latent-crosslinking monomer comprising an N-alkylolamide of an alpha, beta ethylenically unsaturated carboxylic acid having 3 to 10 carbon atoms.

* * * * *